US007217015B2

(12) United States Patent
Cocciardi

(10) Patent No.: US 7,217,015 B2
(45) Date of Patent: May 15, 2007

(54) DEVICE FOR PROPERLY ILLUMINATING AT LEAST ONE FLAG, INCLUDING THE UNITED STATES FLAG

(75) Inventor: Donald E. Cocciardi, 188 Mary La. West, Valley Cottage, NY (US) 10989

(73) Assignee: Donald E. Cocciardi, Valley Cottage, NY (US)

( * ) Notice: Subject to any disclaimer, the term of this patent is extended or adjusted under 35 U.S.C. 154(b) by 50 days.

(21) Appl. No.: 10/995,743

(22) Filed: Nov. 22, 2004

(65) Prior Publication Data

US 2006/0109651 A1 May 25, 2006

(51) Int. Cl.
*F21V 21/116* (2006.01)

(52) U.S. Cl. ..... 362/429; 362/396; 362/430; 362/285; 248/231.71

(58) Field of Classification Search ..... 362/396, 362/413, 429, 431, 269, 282, 285, 287, 430; 248/231, 71
See application file for complete search history.

(56) References Cited

U.S. PATENT DOCUMENTS

| | | | | |
|---|---|---|---|---|
| 1,256,232 | A | 2/1918 | Howard | |
| 1,258,022 | A | 3/1918 | Kray | |
| 1,374,268 | A * | 4/1921 | Whittington | 362/396 |
| 1,381,376 | A * | 6/1921 | Whittington | 362/396 |
| 1,383,234 | A | 6/1921 | Raguse | |
| 1,478,473 | A * | 12/1923 | Herron | 362/277 |
| 1,495,586 | A * | 5/1924 | George | 362/396 |
| 1,515,005 | A * | 11/1924 | Wolter | 362/396 |
| 1,878,447 | A | 9/1932 | Sutphen | |
| 2,247,022 | A * | 6/1941 | Hovorka | 362/396 |
| 3,752,975 | A | 8/1973 | Meyer | |
| 3,923,001 | A | 12/1975 | Murdock | |
| 4,343,032 | A * | 8/1982 | Schwartz | 362/147 |
| 4,823,245 | A * | 4/1989 | Leverte | 362/293 |
| 5,371,663 | A * | 12/1994 | Chuang | 362/293 |
| 5,597,226 | A | 1/1997 | Fast | |
| 5,690,416 | A * | 11/1997 | Van Gennep | 362/396 |
| 5,988,100 | A | 11/1999 | Schmitt | |
| 6,264,351 | B1 * | 7/2001 | Taylor et al. | 362/396 |
| 6,769,795 | B1 * | 8/2004 | Hale | 362/396 |
| 6,951,408 | B2 * | 10/2005 | Stewart | 362/396 |
| 2003/0193804 | A1 | 10/2003 | Schroeder | |

* cited by examiner

*Primary Examiner*—Sandra O'Shea
*Assistant Examiner*—Ismael Negron
(74) *Attorney, Agent, or Firm*—Myron Greenspan, Esq.; Lackenbach Siegel, LLP

(57) ABSTRACT

The device includes means for illumination, means for attaching the device to a flag pole so as to direct the illumination generally in the direction of a flag, and means for selectively energizing the illumination means only during hours of darkness. It is preferred that the means of illumination be permanently connected to a source of energy, such as an external source of AC or DC power, internal battery power or solar power, that provides a photocell-operated switch for monitoring the ambient light and for following the energy source to be directly applied to that illumination means primarily during hours of darkness.

20 Claims, 2 Drawing Sheets

DEVICE FOR PROPERLY ILLUMINATING AT LEAST ONE FLAG, INCLUDING THE UNITED STATES FLAG

BACKGROUND OF THE INVENTION

1. Field of the Invention

The present invention generally relates to illumination devices, and more specifically to an illumination device for illuminating a flag during the hours of darkness.

2. Description of the Prior Art

It is a custom universal to this country to display a flag only from sunrise to sunset on buildings and on stationary flagstaffs in the open. However, according to a law passed by Congress, U.S. Code Title 4, Chapter I, Section 6(a), when a patriotic effect is desired, the flag may be displayed 24 hours a day, but only if properly illuminated during the hours of darkness.

Various illuminating devices for use in conjunction with flags and flag poles have been proposed and used for many years, at least as early as 1918, where an illuminating device is shown and disclosed in U.S. Pat. No. 1,256,232 to Howard. In this patent, a hollow pole is provided with a plurality of openings that are covered by a lens closing each opening. Bulbs are provided within the hollow pole and arranged so as to be aligned with the lenses so that light rays may be projected through the openings in lenses onto the flag. Reflectors are shown used behind the bulbs to enhance the amount of light reflected in the direction of the flag.

In U.S. Pat. No. 1,258,022 to Kray, a socket is attached to the top of a flagstaff. A battery is provided at the lower end of the staff for selectively electrifying the bulb, which is generally arranged above the flag.

In U.S. Pat. No. 1,383,234 to Raguse, a flagpole is shown, in which a series of incandescent lamps are provided at the top of a flagpole, and are connected to suitable electrical source. These lamps are permanently mounted on the flagpole and are activated by a suitable switch. By providing a plurality of angularly spaced lamps, the flag can rotate in a horizontal plane and be illuminated in all positions.

In U.S. Pat. No. 1,878,447 to Sutphen, a metallic flagpole is formed of tubular sections. However, a section adjacent to the flag is made from a translucent or transparent material so that the light generated by fluorescent tubes or incandescent lamps can illuminate a flag.

In U.S. Pat. No. 3,752,975 to Meyer a flagpole light is disclosed in which a lamp fixture,is mounted at the top of the flagpole and is tapered so that light generated within the fixture is reflected downwardly in the direction of the flag.

A fixed light at the based of the flagpole is shown in U.S. Pat. No. 3,923,001 to Murdoch, which can be suitably turned on and off by a switch.

In U.S. Pat. No. 5,597,226 to Fast lamps producing significant amounts of ultraviolet light are used to illuminate commercial flags advertising products and/or establishments. These flags contain ultraviolet light fluorescent material that is illuminated by the ultraviolet light.

U.S. Pat. No. 5,988,100 to Schmitt discloses a device for illuminating display flags. Here, an internally lighted flag mast reflects light externally using reflective materials. When it becomes dark, a photosensor automatically activates a light source for illuminating the flag.

The U.S. Patent Publication No. 2003/0193804 to Schroeder seeks to illuminate a flag so that it may be displayed 24 hours a day. This is done by mounting a light source immediately adjacent to the flag that directs light towards the flag through a transparent portion of the flag-mounting pole, similar to the concept disclosed in Sutphen '447.

In view of the above, it is evident that flagpole lighting devices have been proposed for some time. In most of these patents, however, the light source is integrally and permanently formed with and is part of the flagpole itself. Of course, separate lamps spaced from the light source, such as in Fast '226, have also been proposed. However, by mounting the bulbs at a distance from the flag pole, more powerful light sources are required to illuminate the flag or the illumination is reduced, and the light sources are on the ground, where they can be dangerous obstacles to pedestrians.

In none of the prior art that has been uncovered is there any teaching of a lighting kit that can be selectively attached to and/or removed from an existing flagpole and mounted relatively closely to the position of the flag so that its light intensity may be maintained at a desired level.

SUMMARY OF THE INVENTION

Accordingly, it is an object of the invention to provide a device for properly illuminating a flag during the hours of darkness that does not have the disadvantages inherent in such prior art devices.

It is another object of the invention to provide a device of the type under discussion that is simple in construction and economical to manufacture.

It is still another object of the invention to provide a device as in the previous objects that can be selectively and easily attached to/or removed from an existing flagpole.

It is yet another object of the invention to provide a device for illuminating a flag during hours of darkness that can be mounted on the flagpole relatively closely to the position of the flag so that its light intensity may be maintained at a maximum or desired level.

It is a further object of the invention to provide a device as in the previous objects that can be used with "after-market" light sources and with existing flags and flagpoles.

In order to achieve the above objects, as well as other that will become apparent hereinafter, a device for properly illuminating a flag in accordance with the present invention, which is support on the flagpole, during the hours of darkness, comprises illuminating means for generating light when energized. Attaching means is provided for attaching said illuminating means to a flagpole to direct the illumination generally in the direction of the flag. Means are provided for selectively energizing said illumination means so that the flag is illuminated only during hours of darkness. The device may be operated by an external source of AC or DC power, internal battery power or solar power. Advantageously, the illumination means is permanently connected to a source of energy, and a photo-cell-operated switch is provided for monitoring ambient light and for allowing the source of energy to be directly applied to the illumination means during hours of darkness. And these "after-market" light sources can be used with existing flagpoles. To this extent, they have the advantage that they are not restricted to use with specific flagpoles from specific manufacturers, but rather can be used with all flagpoles, newly manufactured or existing ones.

BRIEF DESCRIPTION OF THE DRAWINGS

The above and other objects of the invention may be more readily seen when viewed in conjunction with the accompanying drawings, wherein.

DESCRIPTION OF THE PREFERRED EMBODIMENTS

Figure 1:
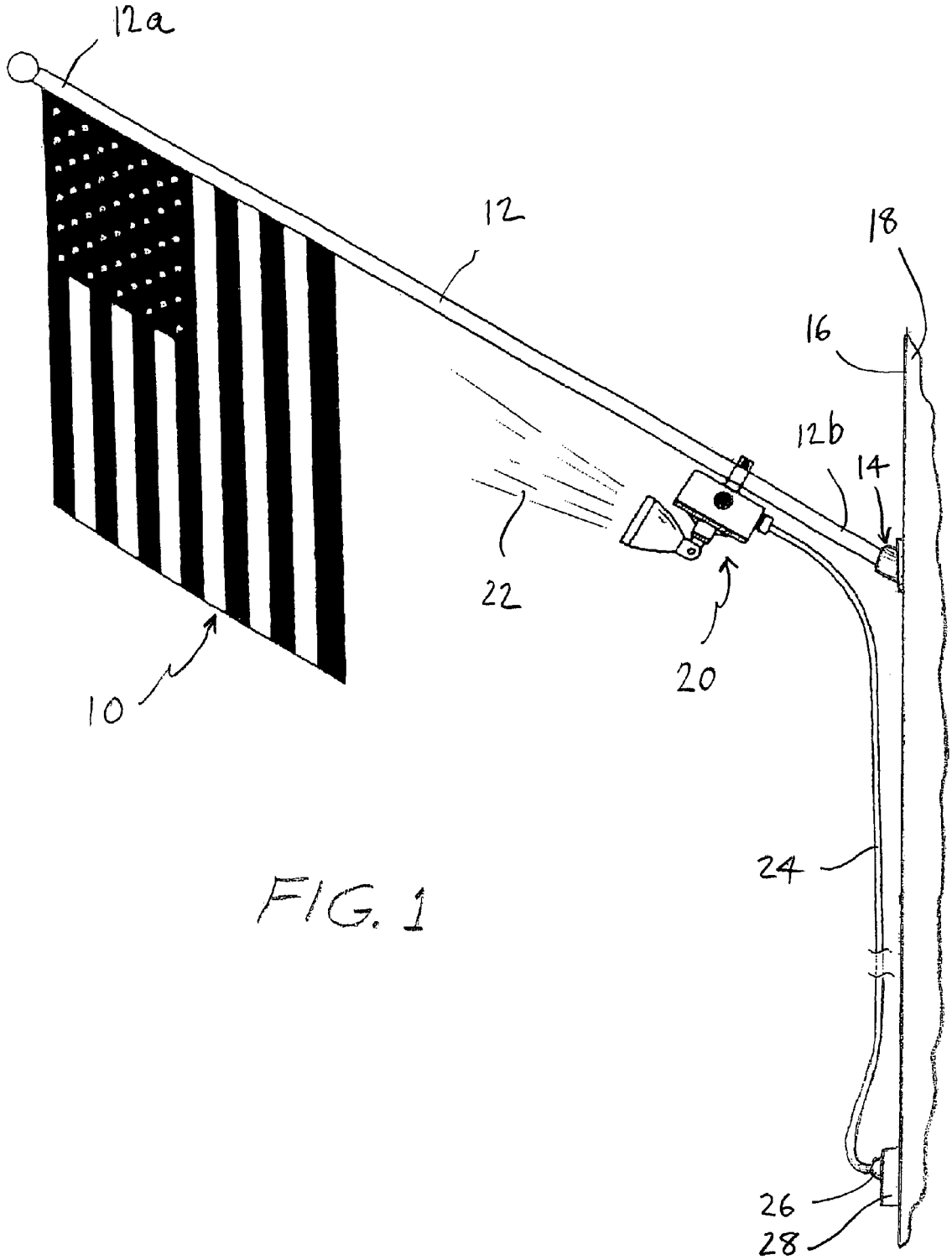
FIG. 1 is a side elevational view of a U.S. flag mounted on a structure such as the outside wall or surface of a building, in which a device for properly illuminating the flag in accordance with the present invention is mounted on the flagpole and arranged to direct a beam of light at the flag.

Referring now specifically to the Figures, in which identical or similar parts are designated by the same reference numerals throughout, and first referring to FIG. 1, a flag, in this case a United States flag, is generally designated by the reference numeral 10. The flag 10 is supported on a flagpole or staff 12 at one outer or remote end 12*a*. At the other or proximate end 12*b*, the flag is shown mounted by means of a bracket 14 to a surface 16 of a structure 18, such as a house or other building.

The device in accordance with the present invention is generally designated by the reference numeral 20, and it is arranged between the two ends 12*a*, 12*b* at a position and manner to direct a beam of illumination 22 in the direction of the suspended flag 10. As will be more fully described in connection with the preferred embodiment, the illumination device 20 is connected by means of a power cord 24 and a plug 26 to an exterior terminal or outlet box 28.

Figure 3:
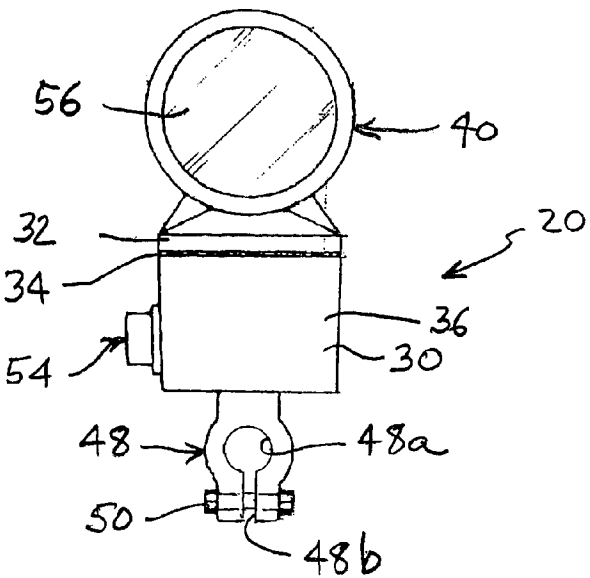
FIGS. 2–4 are different views of the device for providing the illumination shown in FIG. 1, as seen from different directions, and providing additional details of the construction of the device.
Figure 4:
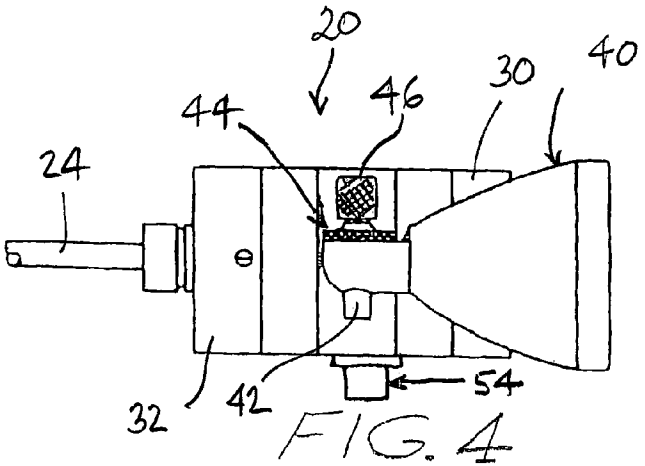
Figure 2:
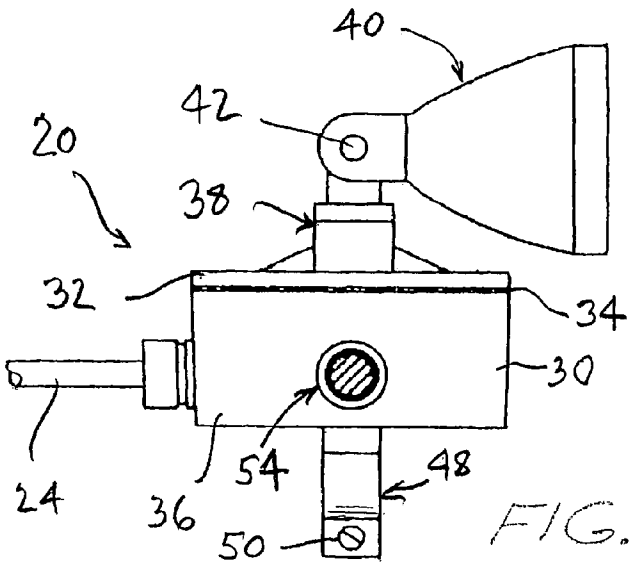

Referring to FIGS. 2–4, the device 20 includes an exterior terminal or junction box 30 in the form of a chassis or housing that is substantially enclosed by means of a cover 32 that is used to close and seal the cover, by means of a sealing material 34, a chassis or housing 36. Extending outwardly from the cover 32 is a mounting or support post 38 to which there is adjustably or pivotably mounted a bulb assembly 40. The bulb assembly 40 is of a common type frequently used for exterior lighting and typically includes a socket (not shown) for receiving a bulb such as an incandescent bulb that may be a floodlamp or a spotlamp. The bulb assembly 40 is mounted to be pivoted or rotatably adjusted about a pin or shaft 42. When positioned in its desired orientation, ribbed locking disks 44 or the like may be utilized and tightened and fix the position of the bulb assembly 40 by means of a knurled adjusting or tightening knob 46.

At the opposing side of the chassis or housing 30, from which the support post 38 extends, there is provided an attaching member for attaching the device to a flagpole so the light the devices generates can be directed generally in the direction of the flag 10. Such attachment device can take any desired or suitable form, and numerous fastening devices will occur to those skilled in the art. In the presently preferred embodiment, one example of such attaching or fastening device is in the nature of a clamp 48 that can be tightened about the flagpole 12.

Figure 5:
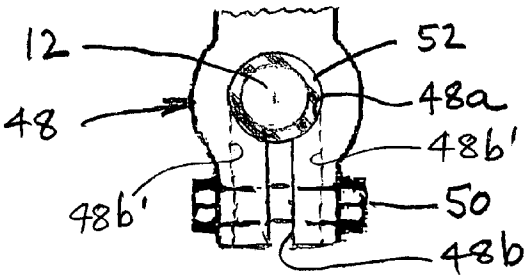
FIG. 5 is a end elevational view of a clamp forming part of the device shown in FIGS. 1–4 for securely attaching the device to the staff of the flag, and further illustrating a sleeve or annular spacer positioned between the external surface of the clamp and the internal surface of the flagpole to accommodate a small diameter flagpole.

Referring to FIGS. 3 and 5, the clamp 48 may be in the nature of a C-clamp having a generally circular inner surface 48*a* and a slot defined by two opposing generally flat surface 48*b*. Thus, the clamp shown is not unlike automotive clamps used for connection to terminal posts of lead-acid batteries. While automotive clamps of the type shown are generally made of lead, the clamp 48 in accordance with the present invention made be made from any suitable material, including plastic, which need not be electrically conductive, as long as gap formed by the two opposing flat surfaces 48*b* can be increased or decreased by tightening or loosening screw or fastener 50. If desired, the surfaces 48*b* can be provided with a greater separation, as suggested by the parallel dashed lines 48*b*' to facilitate mounting of the clamp onto a flagpole without requiring that the clamp be mounted from one end of the flagpole but may, instead, be mounted by simply slipping the clamp over the flagpole at any intermediate portion thereof.

Optionally, there may be provided an insert 52 of a generally compressible material, such as rubber, that can be received between the external surface of the flagpole 12 and the internal surface 48*a* of the clamp for allowing the clamp to be tightened about a flagpole having a diameter smaller than the predetermined or nominal minimum diameter of the opening defined by the circular inner surface 48*a*.

The specific manner in which the device 20 is energized is not critical. Thus, for example, the device may be plugged into a source of AC power, as suggested in FIG. 1. Of course, the power cable or cord 24 may be directly wired into a junction box in lieu of being connected by means of a plug and socket, as shown. Alternate methods of energizing the device are also possible. It will be clear that the device may be powered by conventional batteries that may be housed within the housing or chassis 30. Also, the device may be energized by means of a solar power source of the type well known for storing electrical energy during hours of daylight by converting the sunlight to electrical energy that is stored in storage cells or batteries.

According to a feature of the present invention, the device 20 is selectively energized so that it directs a beam of light 22 at the flag only during hours of darkness. This may, of course, be effected in a number of different ways. A power switch may be provided, either for providing or removing power from the exterior terminal or outlet box 28, or a switch may be provided in line within the power cord 24. Any switch for selectively interrupting power to the device may be used. Since the unit should be energized when darkness begins, this can be done in a number of ways. Clearly, one way is to have a person manually energize the device. However, automatic means may also be used, including an electronic timer, of the type used to turn on and turn off house lamps in the evening. In the presently preferred embodiment, there is provided a light-sensitive element for monitoring ambient light, in the form of a photo-cell 54. When the amount of ambient light decreases below a predetermined threshold, the photo-cell is connected to a well-known circuit for turning on a switch that directs power to the device.

Also in accordance with the presently preferred embodiment, the device 20 is provided with illumination-altering means for selectively changing at least one property of the illuminated beam of light. Thus, referring to FIG. 3, the bulb or lamp assembly 40 includes an optical filter 56 interposed between the bulb and the flag. Such optical filter may comprise a color filter to provide special effects or reflect a special occasion or holiday. The element 56 may also be a protective filter to protect the flag from harmful components of the illuminated light.

It will become evident from the above description that the present invention is in the nature of a "kit" that can be purchased by any owner of a home or business and attached to any conventional flagpole so that the flag may be illuminated, as required by law, should the flag be displayed during hours of darkness.

While this invention has been described in detail with particular reference to preferred embodiments thereof, it will be understood that variations and modifications will be effected within the spirit and scope of the invention as described herein and as defined in the appended claims.

What I claim:

1. A device illuminating at least one flag, supported on a flag pole defining a predetermined direction, said device comprising:

illuminating means for generating light when energized, and having an illumination axis;

attaching means for fixing said illuminating means on said flag pole with said illumination axis and said predetermined direction defining an illumination plane;

adjusting means for rotatably adjusting the illumination axis only within said illumination plane; and means for selectively energizing said illumination means so that the flag is illuminated only during hours of darkness.

2. A device as defined in claim 1, wherein said attaching means includes adjustment means for selectively positioning said illumination means to optimize the amount of light projected on the flag.

3. A device as defined in claim 1, wherein said means for selectively energizing said illuminating means comprises a power plug that can be inserted into or removed from a terminal outlet box.

4. A device as defined in claim 1, wherein said attaching means comprises an exterior weatherproof chassis or housing for protecting said illuminating means during inclement weather.

5. A device as defined in claim 1, wherein said means for selectively energizing includes a solar power source for storing electrical energy during hours of daylight by converting sunlight into electrical energy.

6. A device as defined in claim 1, wherein said attaching means comprises a clamp that can be tightened about the flag pole.

7. A device as defined in claim 6, wherein said clamp is a C-clamp.

8. A device as defined in claim 6, wherein said clamp can be adjusted to a predetermined minimum diameter, and further comprising an insert receivable between the external surface of the flagpole and an internal surface of said clamp for allowing said clamp to be tightened about the flagpoles having diameters smaller than said predetermined minimum diameter.

9. A device as defined in claim 6, wherein said clamp can be sufficiently opened so that it can be placed and mounted on a flagpole at an intermediate position without the need to remove the flagpole from a mounting structure.

10. A device as defined in claim 1, wherein said illuminating means is permanently connected to a source of energy, and said means for selectively energizing said illuminating means comprises a switch for selectively interrupting said connection to said source of energy.

11. A device as defined in claim 10, wherein said switch includes light sensitive means for monitoring ambient light.

12. A device as defined in claim 11, wherein said light sensitive means includes a photo-cell.

13. A device as defined in claim 1, wherein said illumination means comprises a lamp assembly for receiving a bulb.

14. A device as defined in claim 13, wherein said lamp assembly is dimensioned to receive an incandescent bulb.

15. A device as defined in claim 14, wherein said bulb is a flood lamp.

16. A device as defined in claim 14, wherein said bulb is a spot lamp.

17. A device as defined in claim 1, further comprising illumination altering means for selectively changing a property of the generated light.

18. A device as defined in claim 17, wherein said illumination altering means includes optical filter means interposed between said illuminating means and the flag.

19. A device as defined in claim 18, wherein said optical filter means comprises a color filter.

20. A device as defined in claim 18, wherein said optical filter means comprises a protective filter to protect the flag from harmful components of the generated light.

* * * * *